United States Patent [19]

Ogawa et al.

[11] 4,378,685

[45] Apr. 5, 1983

[54] METHOD OF SETTING AXIAL POSITION OF LOOSELY CARRIED SLEEVE IN A ROLLING MILL

[75] Inventors: Shigeru Ogawa; Yūji Uehori; Hiromi Matsumoto, all of Kitakyushu; Koe Nakajima, Nakama, all of Japan

[73] Assignee: Nippon Steel Corporation, Tokyo, Japan

[21] Appl. No.: 228,697

[22] Filed: Jan. 26, 1981

[51] Int. Cl.[3] ..... B21B 31/16

[52] U.S. Cl. ..... 72/21; 72/243; 72/247

[58] Field of Search ..... 72/21, 199, 241, 242, 72/243, 247, 365, 366, 701

[56] References Cited

U.S. PATENT DOCUMENTS 3,018,676 1/1962 Polakowski ..... 72/21

3,210,982 10/1965 Polakowski ..... 72/201

4,299,109 11/1981 Matsumoto et al. ..... 72/241

*Primary Examiner*—Francis S. Husar

*Assistant Examiner*—Jonathan L. Scherer

*Attorney, Agent, or Firm*—Wenderoth, Lind & Ponack

[57] ABSTRACT

A rolling mill includes at least one roll carrying a sleeve loosely on the barrel. The sleeve is inclined slightly by applying radially inward forces at two spaced positions along the outer peripheral surface of the sleeve to displace or to restrict displacement of the sleeve in the axial direction. The force applying points are independent of rotational direction of the sleeve, so that only one unit is needed even where there is reverse rotation. By controlling the relative value between the two forces, the mill can be given a powerful crown controlling capacity for workpieces of varying width, and the sleeve guiding unit is sufficiently durable to withstand high speed rolling during mass production.

6 Claims, 12 Drawing Figures

METHOD OF SETTING AXIAL POSITION OF LOOSELY CARRIED SLEEVE IN A ROLLING MILL

BACKGROUND OF THE INVENTION

The present invention relates to a method of setting the axial position of a sleeve in a rolling mill including at least one roll on which said sleeve is loosely positioned in such a way that the sleeve is revolvable and axially shiftable with respect to the outer circumferential surface of the barrel of the associated roll, said sleeved roll being subjected to a rolling load from one side of the sleeve directed toward the sleeve center onto the outer circumferential surface of said roll barrel along a straight line parallel to the roll axis and which contacts the inner surface of the sleeve with the barrel of the roll, and the roll necks of the roll being subjected to a balancing force for the load through bearing means.

With conventional multiple rolling mills it has been customary to control the flatness and crown of the product by correcting the deflections of the upper and lower working rolls by the applicaton of roll bending forces between those rolls. However, this practice has failed to achieve completely the desired effect because the control functions are limited by the contact of the working roll shoulders with the surfaces of the back-up rolls. Japanese Laid-Open Patent Publication Nos. 103058/76 and 97353/77 proposes methods of controlling the crown of a plate material by positioning sleeves on the back-up rolls of a four stage rolling mill, at suitable positions corresponding to the width of the workpiece. According to those inventions, however, the feasibility of shifting the sleeve positions in order to roll workpieces in varied widths has been considered questionable. More recently, attempts to solve this question have been made as disclosed by Japanese Laid-Open Patent Publication Nos. 48051/78 and 48052/78. These inventions propose rolling mills having a construction generally as shown in FIGS. 1 (*a*) and (*b*), in which sleeves 4 and 4' are loosely positioned on the outer circumferential surfaces of back-up rolls 3 and 3' and adjustment of sleeve-supporting arms permits the sleeves 4 and 4' to be suitably shifted in the axial directions of the rolls according to the width of the workpiece 1 to be rolled, changing the degree of restriction on the shoulders of the working rolls 2 and 2' and thereby controlling the deflections of those rolls. In addition, the effect of the roll bending method is enhanced and the life of the back-up rolls is greatly extended. Thus, the latter publications disclose that the sleeves 4 and 4' are loosely carried by the back-up rolls 3 and 3' and the arms supporting the sleeves 4 and 4' are shifted in the axial directions of the rolls by screw or fluid pressure cylinder means.

As compared with the former two inventions, the latter two publications are distinguished by a construction in which each sleeve 4 is loosely positioned on the associated roll 3 with free space provided between them, so that the sleeve 4 can be shifted axially with respect to the roll according to the width of the workpiece 1 to be handled.

Nevertheless, in high speed rolling operation the mills incorporating these inventions still have the following difficulties. The sleeve-supporting arms, which are subjected to heavy loads, must have great strength. Especially during high speed rolling, contact members or the means attached to those arms in order to deliver restricting forces to the sleeves by direct contact, rapidly wear down. Moreover, the contact members develop so much heat due to friction that considerable cooling is an unavoidable necessity.

SUMMARY OF THE INVENTION

The object of the present invention, in general, is to overcome the above-mentioned difficulties, and to provide a method of setting the axial position of loosely carried sleeves in a rolling mill in which the setting mechanism is subjected to greatly reduced forces and can be used in high speed rolling operation.

To attain the above-mentioned object, it is possible to set the axial position of the sleeve by positioning a contact element at each end of the sleeve, to incline slightly the sleeve axis relative to the roll axis by urging one end surface of the sleeve by the opposed contact element, so that the sleeve is displaced axially. Such a rolling mill is described in U.S. Patent Application Ser. No. 12,195, now abandoned, and continuation application Ser. No. 128,924 thereof now U.S. Pat. No. 4,299,109, British Patent Application No. 7905733, West German Patent Application No. P 29 05 631.3-14, French Patent Application No. 79.04189, and Brazilian Patent Application No. PI 7900912.

The contact element performs desirable sleeve position control. However, the contact position between the sleeve and the contact element is determined as a function of the direction of rotation of the sleeve. Thus, when the rolling mill must be rotated in a reverse direction, the contact position must be changed; i.e. normally two sets of the contact elements and the associated operating mechanism are provided. Thus, the apparatus is complicated.

Further, such apparatus needs considerable space between the end of sleeve and the nearest housing post. Thus, the range of the sleeve shifting is limited.

Thus, the primary object of the present invention is to improve the method and apparatus described in the above described patent and to provide an improved sleeve position setting method and apparatus in which the application of the force to the loosely carried sleeve is independent of the direction of rotation of the sleeve.

Another object of the present invention is to provide a sleeve position setting apparatus which greatly improves the range of the sleeve shifting.

According to a general feature of the present invention, the method of setting the axial position of a sleeve in a rolling mill of the type described, comprises the steps of, in order to displace said in-sleeve in the direction of the axis of said roll, including the sleeve axis slightly in such a direction that the end of the axis toward the direction in which the sleeve is to be displaced is moved in the direction of the movement of said roll and sleeve at said contact line, and to maintain the axial position of said sleeve at a substantially predetermined position, correcting the axial position of the sleeve by utilizing the above-described displacing step to displace the sleeve when the axial position of the sleeve is displaced slightly.

According to a specific feature of the present invention, the method of setting the axial position of a sleeve in a rolling mill of the type described, comprises the steps of, in order to displace said sleeve in the direction of the axis of said roll, applying radially inward forces at at least two points axially spaced relative to each other on the outer circumferential surface of the sleeve, and inclining the sleeve by applying different urging forces from said two points on the outer circumferential surface of the sleeve.

According to a preferred embodiment of the present invention, the method includes detecting the axial position of the sleeve in the direction of the roll axis, and altering the inclination of the sleeve based on the detected position and a reference position, to maintain the sleeve position at a predetermined position or to displace the axial position of the sleeve.

According to another preferred embodiment of the present invention, when the actual axial position of the sleeve is different from the reference position of the sleeve, the method includes applying a force parallel to the roll axis and directed toward the reference position and corresponding in duration to the difference between the actual and the reference positions as determined by a sleeve position detecting mechanism, and at the same time applying to the outer circumferential surface of the sleeve a radially inward urging force which is amplified by a force amplifying mechanism which is inserted between the sleeve position detecting mechanism and the force urging means which urges the sleeve radially inwardly, and said amplifying mechanism amplifies the reaction force produced in the sleeve position detecting mechanism.

By regulating the difference between the radially inward urging forces, the direction of inclination and angle of inclination of the sleeve can be regulated as desired so that the axial position of the sleeve can be easily controlled. The force application points are independent from the rotational direction of the sleeve. Consequently, only one set of an operating member and contact elements can handle both forward and reverse rotation of the sleeve.

The invention will be described in more detail hereinafter with reference to the accompanying drawing in which:

DETAILED DESCRIPTION OF EMBODIMENTS

In this specification, by "loosely positioned" or "- - - carried" is meant a state in which a sleeve is positioned or carried by the associated roll so that during a rolling operation it can rotate together with the roll at the same peripheral velocity, without axial or circumferential restriction but merely by the force of friction at the contacting portions between the outer surface of the roll barrel and the inner surface of the sleeve. In that state there is provided between the two surfaces a visibly discernible clearance of more than one millimeter (practically, in the range of 3–100 mm) and the axis of the sleeve can be tilted relative to that of the roll.

The term "loading point" denotes the circumferential position of the contact point or thin area which is defined when a sleeve loosely carried by a roll receives a force resulting from the rolling pressure and directed toward the sleeve center, from another roll or the workpiece in contact with the sleeve at one side of its outer surface, and where the force so received is transmitted from the inner surface of the sleeve to the outer surface of the sleeved roll. Because this area is a linear region substantially parallel to the axis of the roll, its position is specified in terms of its angular location along the circumference of the sleeve.

At first the relationship between the inclination of a sleeve and the axial displacement of a sleeve will be explained in relation to the rotational direction of a roll by the sleeve position setting device shown in the above described application.

Figure 1A:
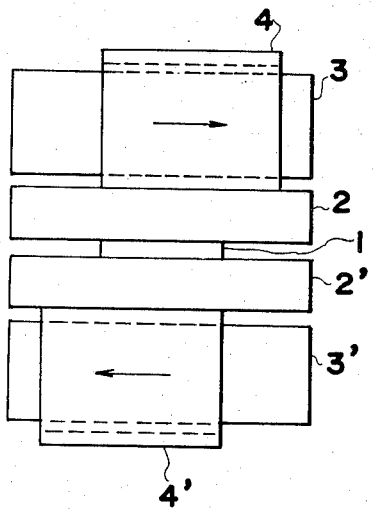
FIG. 1(*a*) is a schematic front view of a rolling mill having loosely carried sleeves, FIG. 1(*b*) is a side view of FIG. 1(*a*), FIG. 2(*a*) is a schematic plan view of a rolling mill to explain the relation between inclination and displacement of the sleeve, FIG. 2(*b*) is a side view of FIG. 2(*a*), FIG. 3(*a*) is a schematic front view of a rolling mill, according to the present invention, having means to vary the inclination of the sleeve, FIG. 3(*b*) is a side view of FIG. 3(*a*), FIG. 4(*a*) is a schematic plan view of FIG. 3(*a*) to explain the relation between radially inward forces and the direction of displacement of the sleeve, FIG. 4(*b*) is a side view of FIG. 4(*a*)
Figure 1B:
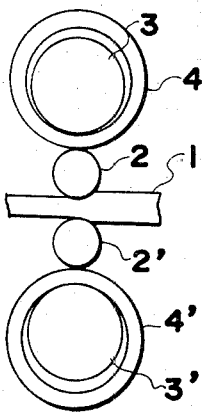
Figure 2A:
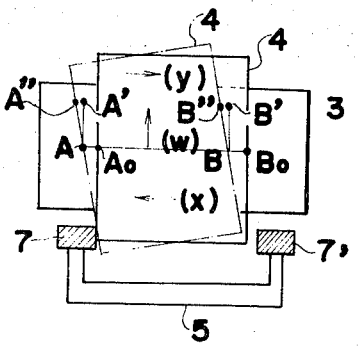
Figure 2B:
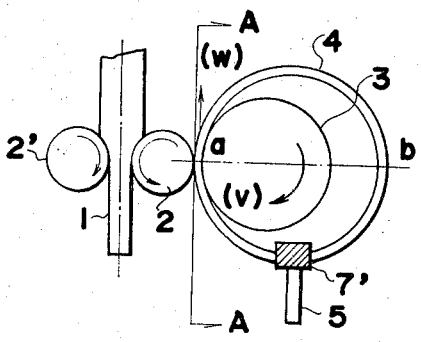

FIGS. 2(*a*) and (*b*) show the movement of a sleeve in the case where the sleeve 4 is carried loosely by each back-up roll 3 of a four stage rolling mill. On the segment AoBo in FIG. 2(*a*) or at the point (a) in FIG. 2(*b*), the sleeve 4 is subjected to a compressive load from the associated working roll 2 and has the outer circumferential surface thereof held in contact with the working roll and the inner surface thereof held in contact with the back-up roll. During a rolling operation, the back-up roll 3 continues to rotate in the direction of the arrow (V) in FIG. 2(*b*). Accordingly, the direction of displacement of the sleeve 4 at the loading point (a) is in the direction of the arrow (W) in FIG. 2(*a*).

The sleeve position setting in this embodiment is performed as shown below. That is to say, the position of the sleeve 4 can be changed or maintained by slowly guiding its both ends at the contact members 7 and 7' which are respectively secured to the arm 5, and by changing or maintaining the position of the arm 5 in the axial direction of the roll.

In order to establish the relationship between the shifting direction of the sleeve 4 and the direction of the axis thereof to be tilted according to this embodiment, the members 7 and 7' are positioned in the circumferential direction of the sleeve 4, as shown in FIG. 2(*b*), on the second semi-circular portion along the sleeve 4 from the loading point (a) in the rotational direction of the sleeve and the roll (shown by the arrow (V), that is, on the semi-circular portion of the sleeve from the opposite point (b) opposite to the loading point (a) to the loading point (a) in the rotational direction of the sleeve and the roll (shown by the arrow (V)).

At first, it is assumed that the sleeve 4 is shifted in the direction of the arrow (Y) in the axial direction of the roll. In this case, the contact members 7 and 7' are shifted in the same direction by the movement of the arm 5 in the direction of the arrow (y). As a result, the sleeve 4 receives a force from the contact member 7 in the direction of the arrow (y). Thus, the axis of the sleeve 4 is, as indicated by dash and dot lines in FIG. 2(*a*), slightly tilted from the direction (y) and is shifted in the direction of movement W of the peripheral surface of the sleeve at the loading point. In the state in which the sleeve 4 is thus tilted, the segment AoBo shown in FIG. 2(*a*) moves to the position A B. Since the sleeve portion subjected to a compressive load that is represented by the segment A B moves in the direction of the arrow (W), due to the rotation of the sleeve the segment A B will move to the position A' B' after rotating for a short period of time.

If the sleeve 4 did not shift in the axial direction while rotating in the tilted state, the segment A B would have to move to the position of the segment A" B" after rotating for a short period of time. However, it will actually move to the position A'B'. This shows that the sleeve 4 will be shifted by this rotational movement in the direction of the arrow (y) only a vector quantity indicated by A"A' within such a time. In this case, if the arm 5, and the contact member 7 are moved only a distance corresponding to the vector quantity indicated by A"A' within the time it takes the segment A B to arrive at the position A'B', the inclination of the sleeve 4 is kept parallel to the corresponding dash and dot lines in FIG. 2(*a*), and then the sleeve 4 will be shifted steadily in the axial direction.

During such forced shifting, the sleeve 4 will move simply by being tilted to a substantially constant angle. The force required at this time to be supplied by the contact member 7 need be sufficient only to maintain the sleeve tilted to that constant angle. The inclination of the sleeve 4 at this time may be represented by the ratio of the length of the segment A"A' to that of the segment AA'. As explained above, this ratio is equal to the ratio of the velocity Vs of axial shifting of the sleeve 4 to the circumferential velocity Vr of the back-up roll, i.e., Vs/Vr. In practice, the sleeve shifting velocity Vs required is very small while the tangential speed Vr is quite high, and usually a ratio of Vs/Vr approximately between 0.001 and 0.01 will suffice for practical purposes.

Thus, even when the sleeve 4 is forcedly shifted in the axial direction, the gradient of inclination of sleeve 4 is quite small, i.e. between about 0.001 and 0.01. Because the geometric relation between the sleeve 4 and the back-up roll 3 requires that the axes of both be kept parallel in the normal state, in order that the sleeve be kept tilted to a given angle, the sleeve 4 and the roll 3 must both undergo elastic deformation to certain degrees in the vicinity of the loading point (a), which suggests that the force which must be exerted on the contact member 7 is approximately proportional to the inclination of the sleeve 4. However, the inclination is actually so small that an extremely small force (according to experiments, for example, at most 0.005X rolling force) is enough for shifting the sleeve 4 in the axial direction.

Next, it is assumed that the sleeve 4 is to be supported at a fixed position. In this case, the arms 5, and accordingly, the contact members 7 and 7' are kept at a fixed position.

If, for some reason, for example, due to nonsymmetric axial distribution of rolling load or to some light abrasion of the rolls, the sleeve 4 has moved in the direction of the arrow (x) in FIG. 2(*a*), then, since the sleeve 4 has been shifted from a fixed position in the direction of the arrow (x), the sleeve 4 must be shifted in the direction of the arrow (y) or the direction opposite to the arrow (x). Such shifting can be attained by such action as described below. When the sleeve 4 moves in the direction of the arrow (x), the contact member 7 is abutted by the side surface of the sleeve 4 facing such member. Therefore, the axis of the sleeve 4 is temporarily tilted as shown by alternate long and short dashed lines in FIG. 2(*a*). Such a tilt is the same as in the case where the arm 5 is shifted in the same direction for the purpose of shifting the sleeve 4 in the direction of the arrow (y). Thus as explained before, the sleeve 4 is moved back in the direction of the arrow (y). However, because the contact member 7 does not move in this case, if the sleeve 4 is moved back in the direction of the arrow (y), the force exerted on the sleeve 4 by the contact member 7 is reduced and the inclination of the sleeve is also reduced. This situation is also the same where the sleeve 4 comes into contact with the member 7' on the opposite side after the sleeve 4 shifts in the direction of the arrow (y). Consequently, the position of the sleeve 4 is maintained by being guided by the contact members 7 and 7'. Thus, where the position of the sleeve 4 is maintained at a fixed position in a manner such as in this embodiment, the inclination of said sleeve is in a direction to automatically correct the displacement from the position. Because such displacement is immediately corrected, the gradient of inclination of sleeve 4 is estimated to be an exceedingly low gradient (according to experiments, below 0.001). Correspondingly to this, the force exerted on the contact members 7 and 7' is also very small.

As the relation between axial displacement and tilting of the sleeve, the explanation given above is for the case where the sleeve is put loosely on the back-up roll of a rolling mill and where the one side of the sleeve is guided by the contact members 7 and 7'. The requirements to be met in practice are:

(1) That each sleeve should be loosely carried by the associated back-up roll so that it can revolve and/or shift axially relative to the roll; and (2) That the sleeve roll should sustain a load that is acting radially from one side of the barrel toward the center of the sleeve so that the outer surface of the roll barrel is contacted by the inner surface of the sleeve, the contact zone being substantially parallel to the roll axis and at the same angular position as the loading point. The essential features are that if the sleeve is desired to be shifted in the axial direction, the sleeve is shifted by inclining the sleeve axis so that the end toward the direction in which the sleeve is to be displaced is shifted in the direction of movement of the periphery of the roll and sleeve at the loading point, or if the sleeve is desired to be supported at a fixed position, a displacement of the sleeve position is corrected by causing the sleeve to be tilted in the same way as for shifting the sleeve.

Accordingly, the types of rolling mills to which the teaching of the method shown in FIG. 2 is applicable are, for example, two stage rolling mills the rolls of which loosely carry sleeves with which to roll the workpiece, and multiple rolling mills the final rolls of which, such as the upper and/or lower back-up rolls of four stage rolling mills, are provided with loosely carried sleeves.

As described, in a rolling mill having at least one loosely carried sleeve, setting the axial position of the sleeve, i.e. axial displacement of the sleeve or retaining the sleeve in predetermined axial position, can be performed by causing a slight inclination of the sleeve, without using much force. However, in the apparatus shown in FIG. 2, the point of application of force on the contact members 7 and 7' is limited depending on the rotational direction of the sleeve. That is, the point must be located somewhere along the second-half semicircular portion of the sleeve as viewed in the direction of rotation of the sleeve from the loading point. This means that, when the rolling mill rotates in the opposite direction, a second set of contact members must be provided to apply a force to the sleeve.

According to the present invention, the force applying point to achieve sleeve inclination is not the end surface of the sleeve, but is a plurality of points spaced axially along the peripheral surface of the sleeve and directed transversely of the sleeve, e.g. radially inwardly toward the center of the sleeve. By suitably varying the radially inward force between the force applying points, the desired direction of inclination and rate of inclination of the sleeve can be achieved. The force applying points are independent of the direction of rotation. This is described in detail hereinafter.

Figure 3A:
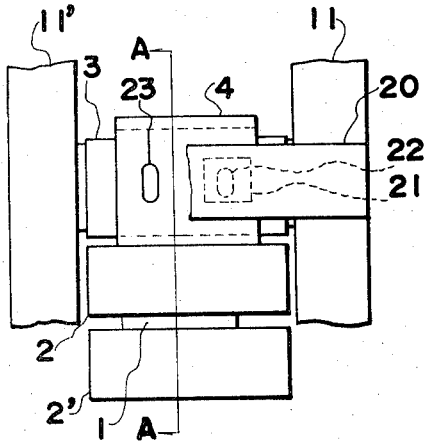
Figure 3B:
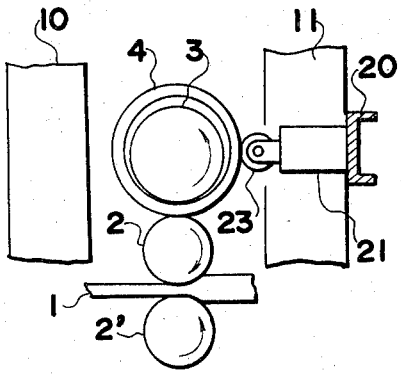

FIGS. 3(*a*) and (*b*) show an embodiment of a method and apparatus for changing the inclination of the sleeve according to the present invention. As shown, the sleeve 4 is loosely placed on the back-up roll 3 and is subjected to a compressive load between the roll 3 and the associated working roll 2 by which the workpiece 1 is rolled. Rollers 22 and 23 are provided at spaced intervals along sleeve 4 so as to apply pressure to the outer circumferential portion of the sleeve 4 and to change the inclination of the sleeve 4. By increasing pressure in the liquid pressure cylinders housed in a housing 21, the rollers 22 and 23 exert forces on the outer circumferential surface of the sleeve 4 and thereby change the inclination of the sleeve. The housing 21 is secured to a bar 20, the bar 20 is secured to posts 11 and 11', and reaction forces exerted on the rollers 22 and 23 are received by the posts 11 and 11'.

Figure 4A:
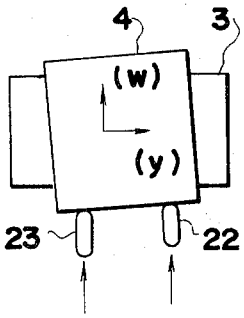
Figure 4B:
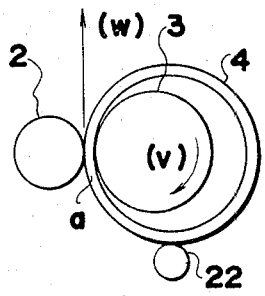

FIGS. 4(*a*) and (*b*) show, for the above-described embodiment, the relationship between the pressure of the rollers 22 and 23 and the direction of shifting of the sleeve 4. Consideration is given to the case where the back-up roll 3 and the sleeve 4 are rotating in the direction of the arrow (V), and accordingly, the velocity of the back-up roll 3 and the sleeve 4 at the loading point is in the direction of the arrow (W) as shown in FIGS. 4(*a*) and (*b*). In this case, if the sleeve 4 is intended to be shifted in the direction of the arrow (y), the axis of the sleeve 4, as already explained, will be slightly inclined from the direction (the arrow (y)) in which the sleeve 4 is to be shifted toward the direction of movement of the periphery of sleeve 4 (the arrow (W)) at the loading point (a) where it rotates. In other words, the pressure of the roller 22 shown in FIG. 4(*a*) must be increased at this time. Conversely, when the sleeve is to be shifted in the direction opposite to that of the arrow (y), it will be clear from the above explanation that the pressure of the roller 23 must be increased.

Figure 5:
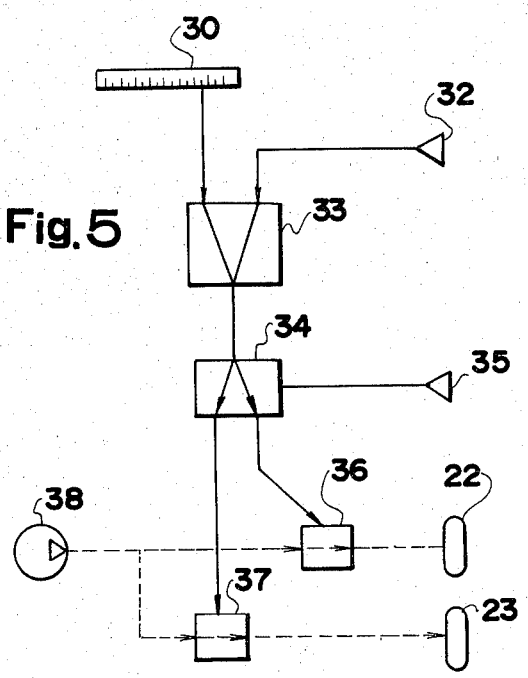
FIG. 5 is a schematic circuit diagram of a circuit to control the mill shown in FIG. 3.

FIG. 5 shows a control circuit to keep the sleeve position in this embodiment at a predetermined position. The solid lines show electric signal circuits and the dotted lines show pressure oil circuits. In this embodiment, the position of the sleeve in the axial direction is detected by a sleeve position detector 30, e.g. a magnetic scale; the difference between the electric signal from the sleeve position detector 30 and the signal issuing from sleeve position setter 32 is obtained from a comparator 33; a decision is made as to which one of the pressure of the rollers 22 and 23 should be increased by a discriminating amplifier 34 depending on whether the signal is plus or minus; a signal for providing pressure is sent to pressure controlling valves 36 and 37 that control the supply of pressure fluid to each of the rollers 22 and 23; pressure oil is supplied from a liquid pressure source 38 to the pressure controlling valves 36 and 37, and depending on which valve has received the signal, is supplied through one of the valves to the corresponding hydraulic cylinder to move the desired one of the rollers 22 and 23. The discriminating amplifier 34 receives a signal from a rolling direction switch 35, and by the output signal of the amplifier 34 one of the pressure to the rollers 22 and 23 is moved depending upon whether the difference between the signal from the sleeve position detector 30 and the signal from the sleeve position setter 32 is plus or minus as well as the direction in which a rolling is being carried out.

When the sleeve is to be supported at a fixed position, the signal from the sleeve position setter 32 is kept constant. The inclination of the sleeve is changed in a direction for correcting its deflection automatically when an actual deflection has occurred in the sleeve position, and thus the sleeve position can be kept substantially fixed. Also, when the sleeve position is to be changed corresponding to a changed rolling condition, the signal from the sleeve position setter 32 is changed to one corresponding to the new sleeve position, and a deflection occurs from the former sleeve position until it reaches the new position. Therefore, the inclination of the sleeve can be controlled in accordance with the deflection, and the sleeve can be shifted to any predetermined position.

Figure 6A:
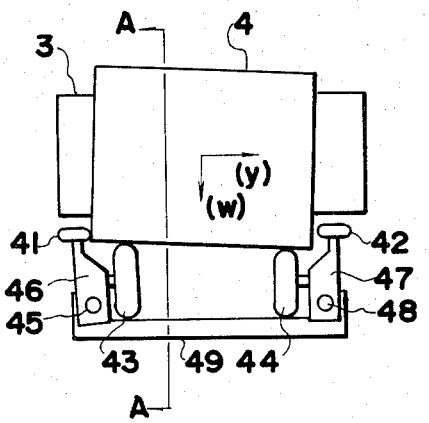
FIG. 6 is a schematic plan view of a rolling mill according to an embodiment of the present invention.
Figure 6B:
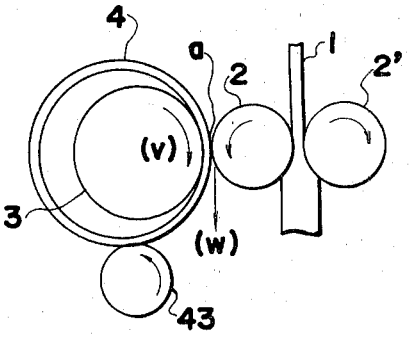

Another embodiment, according to the present invention, is shown in FIGS. 6(*a*) and (*b*). In this case, small rollers 41 and 42 guide both side surfaces of the sleeve 4 which is loosely carried by the back-up roll 3. The rollers 41 and 42 are respectively rotatably supported by lever arms 46 and 47 which are pivotably supported on pins 45 and 48 on a common support arm 49. Large rollers 43 and 44 are rotatably supported by the lever arms 46 and 47 respectively and engages the peripheral surface of the sleeve 4. The support arm 49 can be moved parallel to the axis of the roll 3 and can be secured at any desired point by means not shown. The small rollers 41 and 42 and the large roller 43 and 44 are, as illustrated in FIG. 6(*b*), positioned in the circumferential direction of the sleeve at a point past the loading point (a) in the direction of rotation V of the back-up roll 3 and the sleeve 4.

The method of setting the axial position of the sleeve 4 will be described below. First, when the position of the sleeve 4 is to be shifted in the direction of the arrow (y), the support arm 49 is shifted in the same direction. Then, the small roller 41 contacts with the side surface of the sleeve 4 and receives a force from the sleeve 4. Since the small roller 41 and the large roller 43 are mounted on lever 46 which is pivotable around the pin 45, these rollers 41 and 43 pivot around the pin 45, and the large roller 43 applies pressure to the outer circumferential surface of the sleeve 4.

The direction of the inclination of the sleeve axis for shifting the sleeve 4 in the direction of the arrow (y) is shown in FIG. 6(*a*), in which the sleeve 4 is inclined in such a direction due to the radially inward pressure supplied by the large roller 43. On the contrary, the force supplied by the small roller 41 tends to incline said sleeve in the opposite direction. The support points of the rollers 41 and 43 on the lever arm 46 are selected such that the force exerted by the small roller 41 is increased by the pressure of the large roller 43 and thereby a force supplied by the large roller 43 has a prevailing effect upon the inclination of the sleeve. Thus, the lever arm 46 acts as a force increasing device. In this embodiment, the force exerted upon the outer circumferential surface of the sleeve 4 by the large roller 43 is three times as large as that exerted upon the side surface of the sleeve 4 by the small roller 41, because the distance between the line of action of the pressure of the small roller 41 and the large roller 43 and the pin 45 is in the proportion of about 3 to 1. Thus, the axis of the sleeve 4 can be tilted and the sleeve 4 can shifted in the direction of shifting of the support arm 49.

When the sleeve 4 is to be supported at a predetermined position, the support arm 49 should be maintained at a fixed position. In this case, when the sleeve 4 shifts in a direction opposite to the arrow (y) for some reason, the side surface of the sleeve 4 strikes against the small roller 41; the large roller 43 exerts a force on the outer circumferential surface of the sleeve 4 in the same manner as when the sleeve 4 is shifted in the direction of the arrow (y); the axis of the sleeve 4 is tilted, and then the sleeve 4 shifts in the directon of the arrow (y). Thus, as the sleeve 4 returns to a predetermined position, the force exerted on the sleeve 4 by the small roller 41 and the large roller 43 is also decreased. As a result, the inclination of the sleeve 4 decreases, and then the sleeve 4 is supported at a substantially predetermined position.

Figure 7:
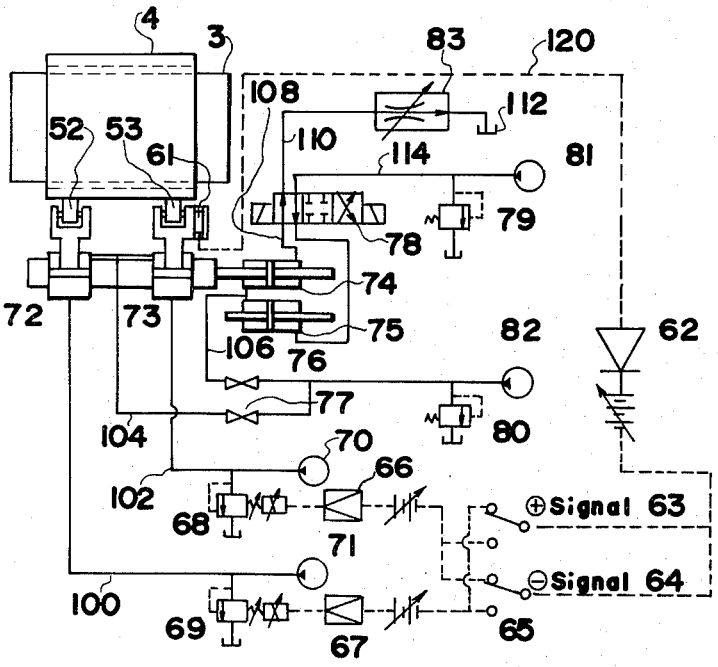
FIG. 7 is a schematic diagram of hydraulic and electronic circuits controlling the rolling mill shown in FIG. 3 and having a sleeve position sensor on the support frame of one urging roller.

FIG. 7 shows a preferred embodiment of the sleeve position setting apparatus according to the present invention. The sleeve 4 is loosely carried by the upper back-up roll 3. The other elements of the rolling mill are eliminated for the sake of clarity. Urging rollers 52 and 53 urge the sleeve 4, as explained above in connection with FIG. 4.

More specifically, to permit movement of rollers 52 and 53 by an urging force applied to the urging rollers 52 and 53, the urging rollers 52 and 53 are rotatably supported on one end of the piston rods of hydraulic cylinders 72 and 73 which are mounted on a common frame slidable parallel to the axis of the back-up roll.

A hydraulic cylinder 74 is connected with said common frame for setting the axial position of the sleeve 4 axially. Another hydraulic cylinder 75 is connected with another common frame, not shown, which supports another set of urging rollers for a lower sleeve.

Hydraulic circuits are provided to control the actuation of the hydraulic cylinders 72, 73, 74 and 75.

The piston head side port of the hydraulic cylinder 72 is connected through a passage 100 with an oil pressure source 71 e.g. a pump. An electro-magnetic proportional relief valve 69 is connected with the passage 100 to control oil pressure in the passage 100. Similarly, the piston head end port of the hydraulic cylinder 73 is connected through a passage 102 with an oil pressure source 70 e.g. a pump, to supply the urging force, and an electro-magnetic proportional relief valve 68 is connected with the passage 102 to control oil pressure in the passage 102. The piston rod end ports of the hydraulic cylinders 72 and 73 are connected through a passage 104 and a valve 77 with an oil pressure source 82 to maintain back pressure in the hydraulic cylinders 72 and 73.

The left end ports of the hydraulic cylinders 74 and 75 are connected through a change over valve, not shown, a passage 106 and a valve 76 with the oil pressure source 82, e.g. a pump. A relief valve 80 maintains oil pressure at outlet of the oil pressure source 82 at a desired predetermined value. The right end ports of the hydraulic cylinders 74 and 75 are connected with the first and second ports of a three position electro-magnetic change over valve 78 respectively. The third port of the change over valve 78 is connected through a passage 110 and a flow rate control valve 83 with a reservoir 112 and the fourth port of the valve 78 is connected through a passage 114 with an oil pressure source 81, e.g. a pump. A relief valve 79 maintains the outlet pressure of the oil pressure source 81 at a desired predetermined value.

A control circuit and the operation of the sleeve position setting apparatus will be explained. A non contact gap sensor 61 is coupled with one of the support arms of the urging rollers 52 and 53, the roller 53 in the illustrated embodiment. When the relative position between the gap sensor 61 and the sleeve 4 is changed from an equilibrium condition, a signal proportional to the changed value is applied to a circuit 120. The signal in the circuit 120 is amplified by an amplifier 62 and is processed by a processing unit, not shown. Then the signal is supplied to positive terminal of change over switch 65 as a signal 63. A signal 64 which has same value and the opposite sign from the signal 63 is supplied to the negative terminal of the switch 65. Outputs of the switch 65 are supplied through power amplifiers 66 and 67 to the electro-magnetic proportional relief valves 68 and 69 respectively. As one of the relief valves 68 and 69 is supplied with a positive signal and the other relief valve is supplied with a negative signal, the urging forces produced by the hydraulic cylinders 72 and 73 are increased and decreased. Thus, the urging forces of the urging rollers 52 and 53 are different. Thus, the angle of inclination of the sleeve 4 relative to the axis of the roll 3 is changed until a new equilibrium is obtained between the relative position of the non contact gap sensor 61 and the sleeve 4 which is automatically supported at substantially the new position relative to the non contact gap sensor 61 by urging rollers 52 and 53.

In the illustrated embodiment, positive signal 63 is supplied to the relief valve 69 which controls the oil pressure supplied to the hydraulic cylinder 72, but it will be understood that a positive or negative signal can be supplied to desired relief valve 68 or 69 and the opposite signal supplied to the other relief valve.

When the above control is completed, the valve 77 is opened. The oil pressure source 82 acts to supply back pressure to retract the urging rollers 52 and 53 radially outwardly from the sleeve 4. The output pressures of the oil pressure sources 70 and 71 are greater than that of the oil pressure source 82 so as to make it possible to obtain the desired urging forces for the urging rollers 52 and 53 against the oil pressure from the oil pressure source 82.

Predetermined bias voltage is applied to the power amplifiers 66 and 67 to prevent the urging rollers 52 and 53 from separating from the sleeve 4 while the system is in operation.

When steel strip or such material is rolled, the rolling mill may be rotated in the reverse direction. In this case, a second unit must be provided for the apparatus shown in FIG. 2, because, the axial shifting force must be applied at a position along the second half semicircular portion of the sleeve as viewed in the rotational direction of the sleeve ending at the loading point. However, according to the present invention the apparatus shown in FIGS. 4 and 7 does not require another unit. When the sleeve is rotated in the reverse direction, the direction of axial displacement of the sleeve 4 relative to the inclination of the sleeve 4 is reversed. Thus, when the rolling mill is rotated in the reverse direction the change over switch 65 is switched to supply an opposite sign signal 63 or 64 to the given relief valve 68 or 69. Thus, the amount of movement of the urging rollers 52 and 53 is reversed.

Since the hydraulic cylinders 74 and 75 are connected with the urging rollers 52 and 53 and lower ones, not shown, which are automatically followed by the sleeves as described above the sleeve position setting hydraulic cylinder 74 displaces the sleeve 4 axially, and the hydraulic cylinder 75 displaces the sleeve, not shown, which is loosely carried by the lower back-up roll of the mill. To displace the sleeve 4 in FIG. 7, the oil pressure source 81 supplies oil pressure through the passage 114 and three position electro-magnetic valve 78 to the hydraulic cylnder 75. The return oil flows from cylinder 74 through the passage 108, three position electro-magnetic valve 78, passage 110, and flow control valve 83 to the reservoir 112 because normally the valve 76 is closed. In this case the sleeve 4 moves rightwards and the lower sleeve moves leftwards. When the position of the three position electro-magnetic valve 78 is charged over, the direction of axial displacement of the sleeves is reversed. The valve 76 is opened only when the relation between the positions of the two sleeves is desired to be changed. By utilizing the hydraulic actuating and controlling apparatus shown in FIG. 7, control is very simple and easily performed. The hydraulic and electronic circuits shown in FIG. 7 are very simple and can be easily modified to perform desired automatic control.

As described before, by applying radially inward urging forces on outer peripheral surface of the sleeve and by controlling the relative value of the urging forces, according to the present invention, force applying points are not limited by the rotational direction of the sleeve. As explained in detail, only one unit can control the sleeve without changing the force applying points for normal and reverse rotation of the sleeve. This is a significant improvement compared with the apparatus shown in FIG. 2, in which the force applying point on the edge surface is limited by the rotational direction of the sleeve.

Further, while the apparatus shown in FIG. 2 needs considerable space between the end of the sleeve and the nearest post, the apparatus shown in FIG. 3 or FIG. 7 doesn't need such space. This improvement provides a great advantage in the control of the flatness and crown of the product of the rolling mill.

It will be appreciated that the sleeve axis is inclined slightly by applying radially inward urging forces to the sleeve to effect axial displacement of the sleeve or to effect correction of the axial position of the sleeve, according to the present invention. The control is performed while the sleeve and roll speed at the loading point is maintained at the same value. Thus, no slip between the sleeve and the roll occurs so that the control force needed is low. Consequently, the sleeve position setting apparatus can be made compact and frictional heating is not great so that the rolling mill with rolls having loosely carried sleeves can be operated at high speed with good sleeve position control.

What is claimed is:

1. A method of changing the axial position of a sleeve in a rolling mill having at least one roll on which said sleeve is loosely positioned and contacting the inner surface of the sleeve along a straight line parallel to the roll axis for rotating of the sleeve with the roll, said sleeve further being axially shiftable along the outer circumferential surface of the said one roll, said one roll, during normal operation of said rolling mill, being subjected to a rolling load from one side of the sleeve directed toward the sleeve center and onto the outer circumferential surface of said one roll, and the roll necks of said one roll being subjected to a balancing force for said load through bearing means, said method comprising displacing said sleeve in one direction along said roll axis by exerting on said sleeve transversely thereof a force which produces a force transversely of said sleeve axis for inclining the sleeve axis slightly so that the end toward which it is desired to displace the sleeve is moved in the same direction as the direction in which said sleeve is moving at the line of contact of said one roll with the inner surface of said sleeve.

2. The method as claimed in claim 1 in which the step of of exerting said force comprises exerting a force transversely of the sleeve at a point toward the end toward which it is desired to displace the sleeve, said force being exerted in a direction for moving the corresponding end of the axis of the sleeve in the same direction as the direction in which the sleeve is moving at the line of contact of said one roll with the inner surface of said sleeve.

3. The method as claimed in claim 1 in which the step of exerting said force comprises exerting one portion of said force transversely of said sleeve at one of two points along the length of the sleeve and the remainder of said force transversely of said sleeve at a second of the two points along the length of the sleeve, the strength of the portion of the force exerted at the point toward the end toward which the sleeve is to be displaced being greater than the strength of the portion of the force exerted at the point toward the other end and being exerted in a direction for moving the corresponding end of the axis of the sleeve in the same direction as the direction in which the sleeve is moving at the line of contact of said one roll with the inner surface of said sleeve.

4. The method as claimed in claim 1 in which the step of exerting said force comprises exerting a force transversely of the sleeve at a point toward the end opposite the end toward which it is desired to displace the sleeve, said force being exerted in a direction for moving the corresponding end of the axis of the sleeve in the opposite direction from the direction in which the sleeve is moving at the line of contact of said one roll with the inner surface of said sleeve.

5. The method as claimed in claim 4 in which the step of exerting said force further comprises exerting a slight force on the end of said sleeve opposite the end toward which the sleeve is to be displaced and directed parallel to the axis of the sleeve, and amplifying the reaction to said slight force for producing the transverse force.

6. The method as claimed in claim 5 further comprising, prior to exerting the force on said sleeve, establishing a position to which the sleeve is to be displaced, sensing the position of the sleeve, and then as the force is exerted, comparing the sensed position of the sleeve with the desired position and when the sensed position coincides with the desired position, discontinuing the exerting of the force.

* * * * *

UNITED STATES PATENT AND TRADEMARK OFFICE

CERTIFICATE OF CORRECTION

PATENT NO. : 4,378,685

DATED : April 5, 1983

INVENTOR(S) : Shigeru Ogawa; Yuji Uehori; Hiromi Matsumoto

It is certified that error appears in the above—identified patent and that said Letters Patent is hereby corrected as shown below:

Column 3, line 51, after "3(a)" insert --taken along the line A-A --.

Claim 1, line 20; Claim 2, line 7; and Claim 3, line 13, change "moving" to --rotating--.

Signed and Sealed this

*Seventeenth* Day of *April 1984*

[SEAL]

*Attest:*

GERALD J. MOSSINGHOFF

*Attesting Officer*

*Commissioner of Patents and Trademarks*